United States Patent [19]

Harmon

[11] Patent Number: 4,691,952

[45] Date of Patent: Sep. 8, 1987

[54] CLUTCHING ADJUSTABLE KEEPER MECHANISM

[75] Inventor: Raymond E. Harmon, Orange, Calif.

[73] Assignee: Rexnord Inc., Brookfield, Wis.

[21] Appl. No.: 915,588

[22] Filed: Oct. 6, 1986

[51] Int. Cl.[4] ..... E05B 15/02; E05C 3/04

[52] U.S. Cl. ..... 292/341.18; 292/113; 292/241

[58] Field of Search ..... 292/341.18, 0.60, 241, 292/242, 113

[56] References Cited

U.S. PATENT DOCUMENTS

| | | | |
|---|---|---|---|
| 2,904,141 | 9/1959 | Henrichs | 292/341.18 |
| 3,608,939 | 9/1971 | McBurnie et al. | 292/341.18 |
| 3,640,141 | 2/1972 | Hollingsead | 74/89.15 |
| 4,183,564 | 1/1980 | Poe | 292/113 |
| 4,209,194 | 6/1980 | Poe | 292/341.18 |
| 4,220,364 | 9/1980 | Poe | 292/341.18 |
| 4,320,912 | 3/1982 | Grace et al. | 292/341.18 |
| 4,478,446 | 10/1984 | Duran | 292/341.18 |
| 4,530,529 | 7/1985 | Poe et al. | 292/341.18 X |
| 4,534,234 | 8/1985 | Cosenza | 74/89.15 |
| 4,538,843 | 9/1985 | Harris | 292/341.18 X |

*Primary Examiner*—Gary L. Smith
*Assistant Examiner*—Carl M. DeFranco, Jr.

[57] ABSTRACT

A mechanism for reliably adjusting and securing the load applied through a keeper and a tension latch assembly is provided. The mechanism includes a housing (25, 35), a drive system (50, 70) for effecting the adjustment, and a clutching arrangement (50, 60, 70, 80) within the housing which prevents the drive system from effecting any further adjustment when a pre-determined load is achieved between the keeper and the hook of the latch assembly. Other features include the placement of the driving component, accessed by the operator, at a location external to the housing and provision of audible and physical indicators for the benefit of the operator when the desired load adjustment has been accomplished.

2 Claims, 10 Drawing Figures

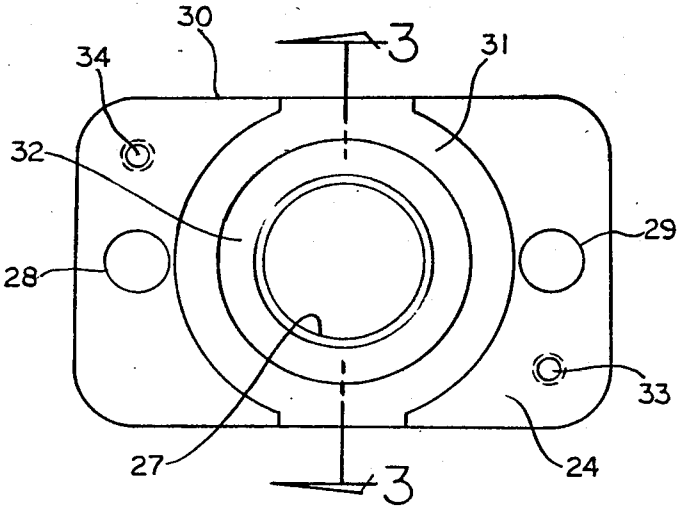
FIG 2
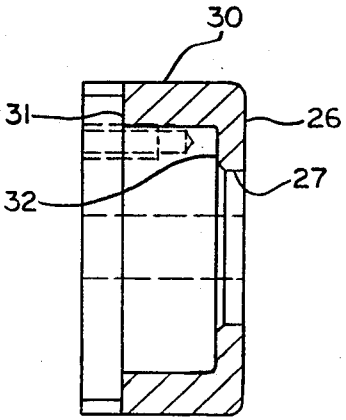
FIG 3
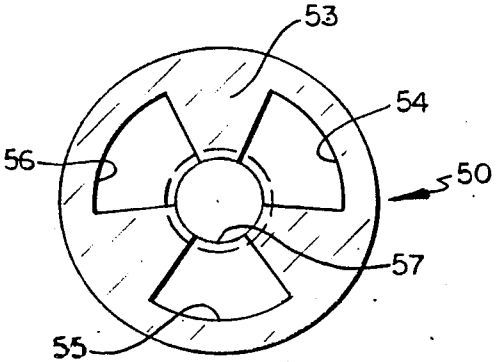
FIG 4
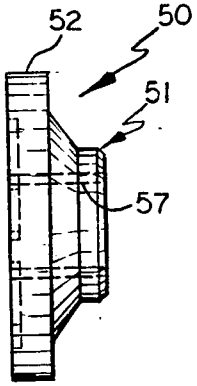
FIG 5
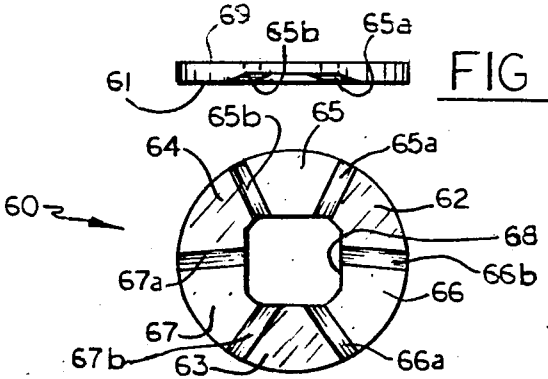
FIG 7
FIG 6

CLUTCHING ADJUSTABLE KEEPER MECHANISM

TECHNICAL FIELD

The present invention relates to tension latch assemblies in which a keeper element is placed under a load with respect to a fixed-position hook element. In particular the present invention relates to mechanism for adjusting the position of the keepr relative to the hook element.

BACKGROUND

Adjustable keepers are known in the latch art field and play a critical role in the proper operation of the latch assemblies. As new demands are placed on the latch assemblies used in developing aircraft and aerospace vehicles, the components of such assemblies are subject to change. Thus the art for adjustable keepers must be further developed in order to meet the new demands of the vehicles in which they are placed. Accordingly, the present invention has been developed to provide a mechanism by which a tension latch assembly may be adjusted reliably and secured in the adjusted condition during the operating conditions to which the vehicle is subjected.

SUMMARY

The present invention is a mechanism for adjusting the load applied through a keeper in a tension latch assembly. The mechanism includes a housing, a drive system for effecting the adjustment, and a clutching arrangement within the housing which prevents the drive system from effecting any further adjustment when a pre-determined load is achieved between the keeper and the hook of the latch assembly.

The unique feature of the invention, which advance the art beyond present adjustable keeper technology, include: The use of a clutching mechanism which automatically stops the operator from overloading the latch assembly or surrounding structure and thereby preventing the operator from causing serious damage to the vehicle as a result of such overloading; placement of the driving component external to the housing; and a resulting audible and physical sensation which alerts the operator that the desired load adjustment has been accomplished.

The foregoing is accomplished in a preferred embodiment by the use of a two piece housing which loads the components contained therebetween. Such components are a keeper adjuster nut, a drive element and a clutching mechanism. Specifically, the drive element extends beyond the housing and is operated by the user at a location which is external to the housing. The clutching mechanism in this preferred embodiment includes a portion of the drive element and a recessed surface of the adjuster nut which contain between them a compression spring arrangement. Also included is a backing plate which engages the recessed nut surface when the clutching mechanism is engaged during the adjustment of the keeper. The clutching mechanism is constructed and arranged such that when the pre-determined load between the keeper and the hook is achieved by the operator's adjustment action, the backing plate is caused to disengage the nut recessed surface and thereby prevent any further adjustment to be effected by the operator. At that time the mechanism components create an audible clicking sound and transfer a physical sensation through the adjustment tool to the operator.

These and other unique features of the present invention will be described in greater detail in the detailed description of a preferred embodiment which follows.

BRIEF DESCRIPTION OF THE DRAWINGS

FIG. 2 is a front plan view of one portion of the housing of the preferred embodiment.

FIG. 3 is a side view in cross-section of what is shown in FIG. 2.

FIG. 4 is a plan view of the nut component of the preferred embodiment.

FIG. 5 is a side elevational view of the nut shown in FIG. 4.

FIG. 6 is a plan view of the backing plate of the preferred embodiment.

FIG. 7 is a top plan view of what is shown in FIG. 6.

DETAILED DESCRIPTION OF A PREFERRED EMBODIMENT

Turning now to the drawings, a preferred embodiment of the present invention is shown as it would be assembled with a conventional keeper of a tension latch assembly. The remaining tension latch assembly, i.e. hook, handle, and mounting structure, is not shown as it is believed persons skilled in the art will appreciate the structure and function of the invention without requiring the illustration of a keeper being engaged with a hook of a conventional tension latch assembly. The individual components and construction of a preferred embodiment of the invention will be described first, followed by a complete description of the operation of the preferred embodiment and the advantages provided by the present invention.

Figure 1:
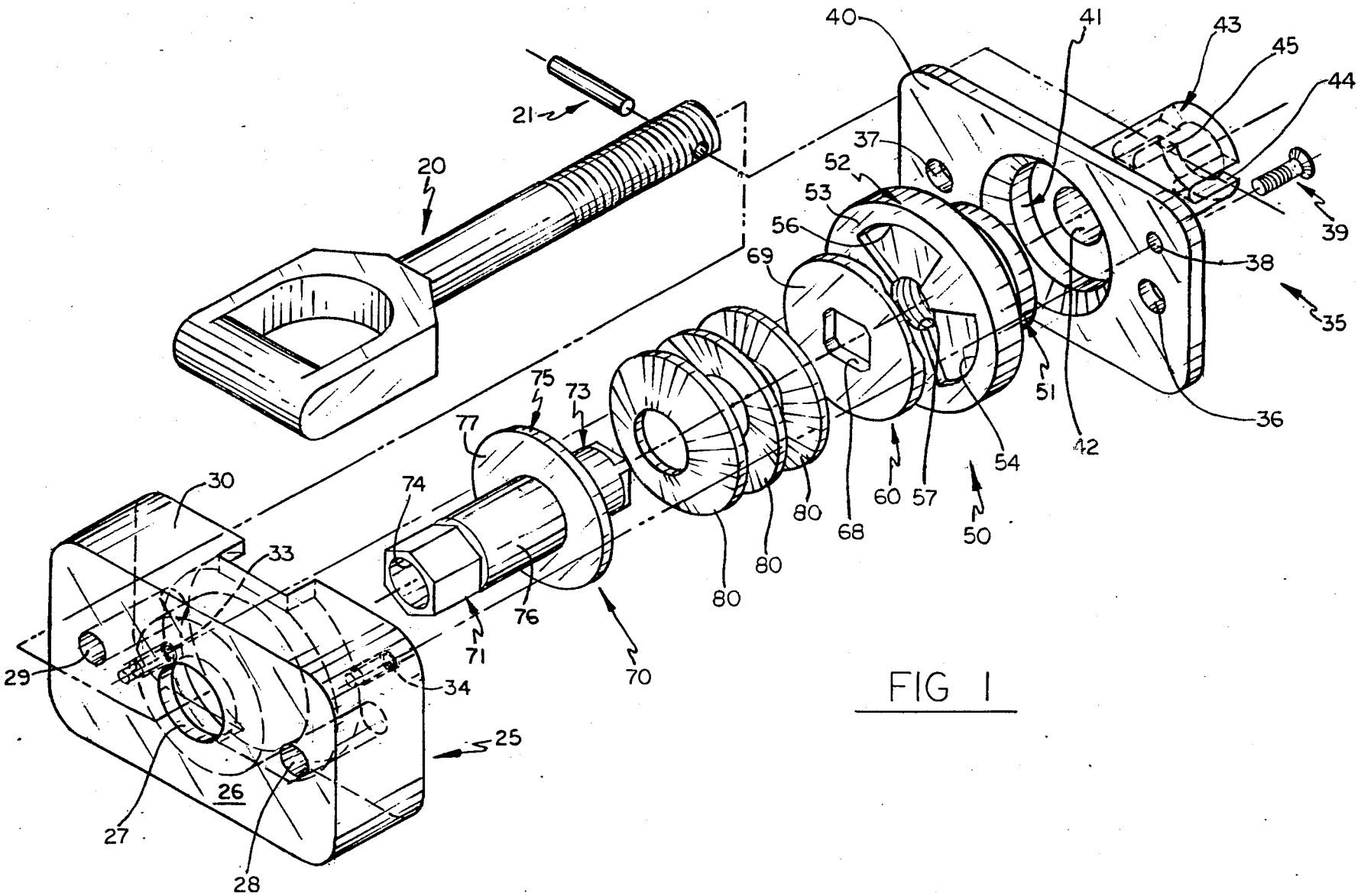
FIG. 1 is an exploded view in perspective of the components of a preferred embodiment for the present invention.

FIG. 1 illustrates in exploded fashion the various components and their orientation with each other in the assembly of a preferred embodiment. A conventional keeper 20 and pin 21, for preventing rotation of the keeper relative to the completed assembly, are shown. The remaining items are the components of the preferred embodiment.

A housing is provided which has two portions, between which are secured several other components. A first housing portion 25 is shown in greater detail in FIGS. 2 and 3. As can be seen in FIGS. 1, 2, and 3, the first housing portion 25 is a substantially rectangular enclosure having one substantially open end 24. A more closed end 26, opposite the open end 24, contains a through-hole 27. Also provided in this end 26 are a pair of holes or openings 28, 29 each of which receives a fastener for mounting the completed assembly to a structure, e.g. an aircraft. Forward of this end is a continuous side wall 30 which defines the outer perimeter of the first housing portion 25. Within the first housing portion 25, recessed circular surfaces 31, 32 are provided for reasons to be explained hereinafter. At the open end 24 a pair of apertures 33, 34 are provided for use in securing the two housing portions 25, 35 together.

The second housing portion, hereinafter referred to as the back cover 35, has a first end constructed as a cover for the open end 24 of the first housing portion 35. As can be appreciated from a study of FIGS. 1 and 8, the back cover 35 includes a pair of through-holes 36, 37 positioned in alignment with the mounting through-holes 28, 29 of the first housing portion. It also contains a second pair of through-holes (one of which is shown 38, the second which is not shown) positioned in alignment with the openings 33, 34 in the first housing portion 25. A conventional retainer 39, e.g. a screw or rivet, may be used to secure the two housing portions 25, 35 together through the aligned openings 33, 34, 38. The end of the cover plate 35 has a substantially flat surface 40 which abuts against the similar flat surface 24 of the first housing portion 25. Centrally located with respect to this surface 40 is a circular counterbored surface 41 configured in accordance with the exterior surface of a nut element which fits therein. The nut will be described further below. This circular opening area 41 extends from the flat surface 40 to a through-hole 42. The through-hole 42 continues through to the opposite end 43 of the cover plate. This end 43 is constructed to be integral with the first end of the back cover 35 and is substantially cylindrical in shape. The through-hole 42 has a diameter which permits the threaded shaft portion of the keeper 20 to move freely therein. The cylindrical end 43 is provided at its free end with two opposing open-ended pair of slots 44, 45 into which the keeper anti-rotation pin 21 is inserted in the conventional manner relative to the keeper.

Continuing now with a second part of the invention, a drive system for the preferred embodiment will be described. The drive system permits the operator to adjust the keeper position relative to a fixed position of the latch assembly hook. In the preferred embodiment a nut 50 is provided for translating the rotational movement of the drive system into axial forward or rearward movement of the keeper relative to the hook. As can be seen in FIGS. 1, 4 and 5, the nut of the preferred embodiment has two ends, one 51 of which is configured to fit within the counterbored surface area 41 of the back cover 35. The other end 52 is configured so as to fit within the recessed surface area 31 of the first housing portion. The second end 52 of the nut includes a bearing surface 53, which in FIG. 9 it can be seen to bear against the recessed surface 31 of the housing portion 25 when the keeper is under a load. This bearing surface 53 of the nut 50 is provided with three recessed areas or pockets 54, 55, 56 arranged around a threaded through-hole 57 which extends through the nut from end to end, as can be seen in FIG. 4. In the preferred embodiment, three substantially triangular areas were selected. A threaded through-hole 57 threadably engages the keeper 20 for effecting adjustment of the keeper.

A backing plate 60 is positioned on the recessed bearing surface 53 of the nut 50. The backing plate provides a second part of the drive system in that one side 61 of the plate 60 has raised surface areas or extensions 62, 63, 64 which correspond to and fit within the recessed areas 54, 55, 56 respectively of the nut 50. Extending between and connecting each adjustment pair of raised surface areas e.g. 62, 63 is a lower lying or recessed area, e.g. 66 and ramp surfaces e.g. **66*a*, 66*b* which connect the recessed area with the adjacent raised surface area. This construction is illustrated in FIGS. 6 and 7. A second set of like ramp surfaces 67*a*, 67*b*, 65*a*, 65*b*, and two other recessed surface areas 65, 67, extend between the other pairs of raised surface areas, i.e. 63, 64 and 64, 62. The angle of inclination of each ramp surface directly affects the load relationships present in the invention. In the preferred embodiment, an angle of twenty degrees has been selected for the ramp surfaces 65*a*, 66*a*, 67*a* which function during the application and adjustment of the load on the keeper. The anle for the second set of ramp surfaces 65*b*, 66*b*, 67*b* in the preferred embodiment will be equal to or less than the twenty degree or other selected angle for the first set of ramp surfaces 65*a*, 66*a*, 67*a*. The function of the second set of ramp surfaces 65*b*, 66*b*, 67*b* will be explained further hereinafter. It should be appreciated by those skilled in the art that the selected angles of inclination for the ramp surfaces may be varied depending on the load and torque requirements desired for the mechanism. The opposite surface area 69 of the backing plate is generally flat. In the center of the backing plate 60 a through-opening 68** which is non-circular is provided.

A third element of the drive system is the drive element 70. The drive element includes a shaft having a one end a hex-shaped outer surface 71. In the preferred embodiment a hex-shape was selected as it would accommodate a conventional open-ended wrench permitting the operator to rotate or drive the system. This driving end 71 is of a size which permits it to extend through the first housing portion opening 27 and be positioned beyond the exterior of the housing. At the opposite end 73, the shaft is terminated in a non-circular fashion. In the preferred embodiment the shape of the backing plate through-hole 68 and the shape of the drive element second end 73 are complimentary such that rotation of the drive element 70 will cause simultaneous rotation of the backing plate 60 when the backing plate is positioned in the drive element second end 73. A through-hole 74 extends through the drive element from end to end and is of a size to permit the keeper to move therein as it is adjusted. The drive element 70 further includes a portion 75 which extends outward from its outer wall 76 to provide a pair of bearing surfaces 77, 78 for the third part of the invention.

The third part of the invention is the clutching mechanism by which the drive system is disabled so as to prevent the operator from adjusting the keeper beyond a pre-determined load. Included in the components of this clutching mechanism are the bearing surfaces 77, 78 of the drive element 70. One of the bearing surfaces 77 is positioned so as to abut the innermost recessed aea 32 of the first housing portion 25. The other bearing surface 78 is reacted against by the spring components 80 of the clutching mechanism. In the preferred embodiment a plurality of spring washers e.g. Belleville-type washers, are stacked on the second end 73 of the drive element between the drive element bearing surface 78 and the flat surface 69 of the backing plate 60. The invention is not restricted however, to the use of any specific type of compression spring. The important aspect of the spring means in the invention is to provide the mechanism a pre-determined internal pre-load for reasons to be explained as follows.

Figure 8:
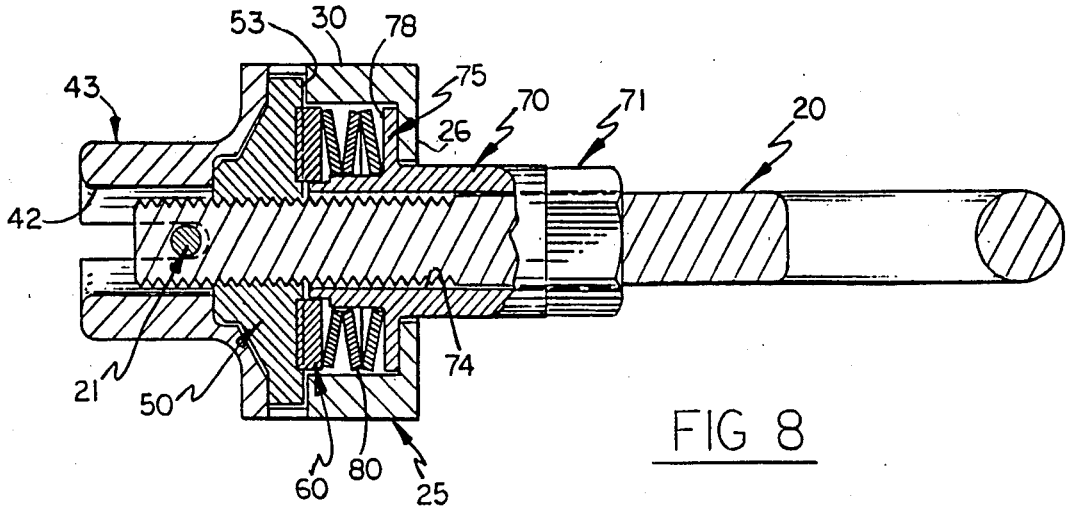
FIG. 8 is a view in cross-section of the assembled preferred embodiment illustrating the embodiment in a non-adjustable condition.
Figure 9:
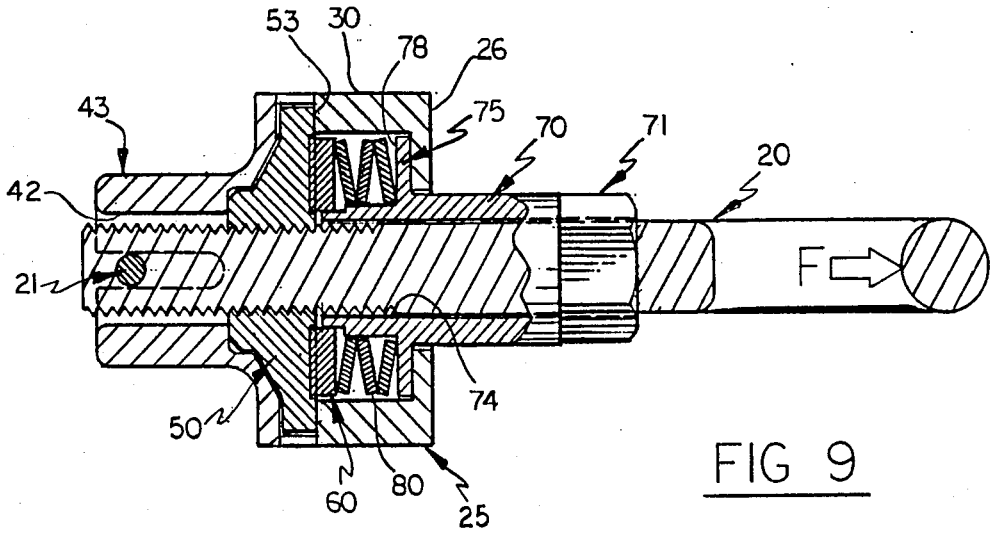
FIG. 9 is a view in cross-section of the assembled preferred embodiment as it would appear after adjustment of the load on the keeper element.
Figure 10:
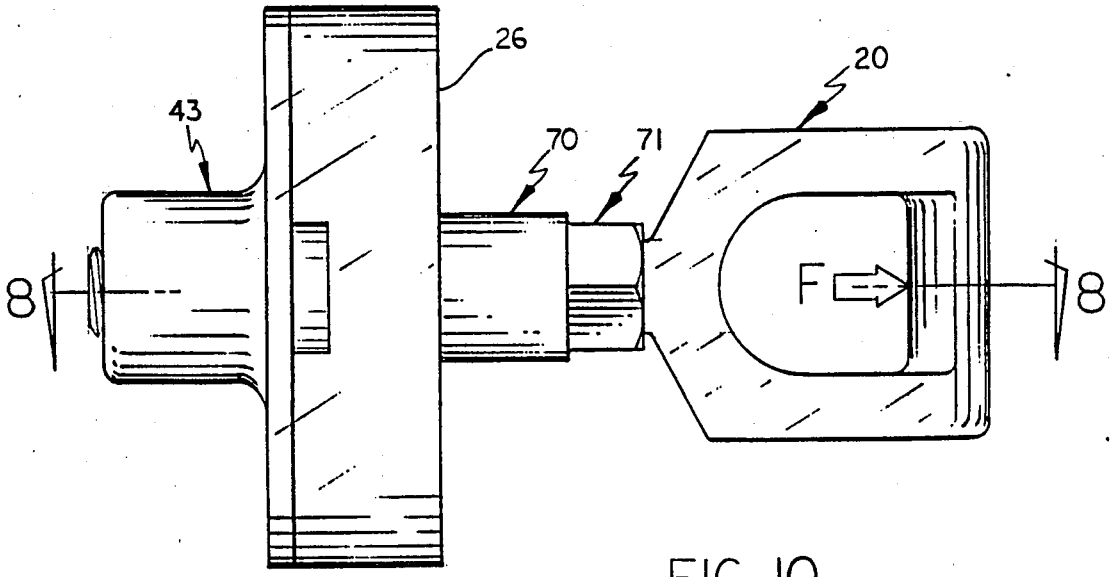
FIG. 10 is a top plan view of the assembled, adjusted preferred embodiment shown in FIG. 9.

Having described the structure of each of the components of the preferred embodiment and with reference now to FIGS. 8 and 9, the operation of the assembled adjusting mechanism may be described.

In FIG. 8 the keeper 20 is shown in its unloaded relationship with the adjusting mechanism. In this condition it is assumed that the keeper is latched to the hook of the latch assembly, but it has not yet been adjused for the desired load between the keeper and the hook. It should be noted that in this condition the nut 50 is bearing against the flat surface 40 of the back cover 35 as a result of the static spring force present in the invention. Also, in this condition the backing plate raised surface areas 62, 63, 64 are engaged with the recessed surfaces 54, 55, 56 of the nut 50. The drive element 70 is thus spring-loaded so as to bear against the recessed surface 32 to the first housing portion 25. Under these conditions the static spring force present in the mechanism exceeds the force resulting from any load existing at that point in time between the keeper and the hook.

As the tool of the operator rotates the drive element 70 at its external first end 71, the backing plate 60 simultaneously rotates as it is captured on the drive element by its non-circular through-hole 68. Due to the static spring force, rotation of the backing plate 60 causes simultaneous rotation of the nut because of the engagement of the backing plate raised surfaces 62, 63, 64 with the nut recessed areas 54, 55, 56 respectively. Accordingly, rotation of the nut 50 is translated into axial movement of the keeper 20 due to the presence of the anti-rotation pin 21. The direction of rotation is such as to cause the keeper to move axially in a direction away from the stationary hook, and thereby increasingly adjust the load between the keeper and the hook. All the while the spring force continues to position the backing plate into engagement with the nut for simultaneous movement with the drive element. Rotation of the drive system thus continues until the load between the keeper and the hook equals the spring load acting on the backing plate 60. As the two loads approach an equilibrium the backing plate 60 begins to move along the drive element end 73 and out of engagement with the nut. This disengagement is accomplished by the ramp surfaces 65*a*, 66*a*, 67*a* of the backing plate and the provision of sufficient length and propeer surfacing at the drive element second end 73 to permit the backing plate to travel out of the nut recessed areas. When the two loads equalize, the mechanism clutches out as the load between the keeper and the hook exceeds that of the spring force. Immediately the operator will hear a clicking sound as the force of the spring is overcome by the force of the adjusted load. The backing plate ramp surfaces are the source of this clicking sound as they sequentially and abruptly return into the nut recessed areas under the force of the compression springs as the operator continues to rotate the drive element. The operator will accordingly feel a dramatically reduced level of torque being required to operate his tool in order to effect rotation of the drive element. Any continued rotation of the drive element by the operator will be ineffective as the disengaged clutching mechanism prevents any further rotation of the nut and thus no further load adjustment of the keeper is possible. With the present invention the operator should not be able to overload the supporting or adjacent structure. This final adjusted condition of the keeper under the desired load F with respect to the hook is shown in FIG. 9. It should be noted that in this condition, the bearing surface 53 of the nut 50 bears against the recessed surface 31 of the first housing portion.

During the time in which tthe latch assembly remains under the load to which the keeper has been adjusted, the invention provides a further advantage. The construction of the invention maintains the nut 50 in an essentially non-rotatable condition as a result of the presence of the second set of ramp surfaces 65*b*, 66*b*, 67*b*. Thus the integrity of the keeper adjustment is assured in that the presence of the second set of ramp surfaces 65*b*, 66*b*, 67*b* prevents any reverse rotation of the drive element from effecting the keeper adjused positions. The mechanism will continue to clutch out when the drive element is rotated either clockwise or counterclockwise, so long as the keeper is under the adjusted load with the hook. In order to adjust the keeper back to a condition such as illustrated in FIG. 8, the latch assembly must be unlatched, so that the static spring force load once again exceeds any load present on the keeper. Under the force of the greater static spring load, the clutching mechanism may once again engage with the drive mechanism, and reverse rotation of the drive element is translated to the nut, yielding a reverse axial movement of the keeper.

In view of the foregoing, the advantages over the prior art now provided by the invention should be appreciated. The present invention, as used in combination with a tension latch assembly in an industry such as aerospace, provides reliable keeper adjustment and is operable in confined areas where the operator has limited access for accomplishing the adjustment. Common hand tools may be used to accomplish the adjustment for achieving the preload tension requirements between a fixed structure and an adjacent movable item such as a cowling door. Such requirements are of critical importance in an industry such as that of aerospace, and now can be accomplished by the invention without the prior art needs for special operator handling or judgement calls by latch rigging specialists to verify that the load requirements are met.

An alternate embodiment for the drive element of the invention is contemplated in which the adjustment, rather than being "in-line" with the keeper load line, is accomplished at right angles to the load line. The preferred embodiment illustrates an "in-line" load adjustment arrangement. The contemplated alternate embodiment could include modifying a portion of the drive element. For example, the drive element may be provided with a peripheral gear surface. Adjacent that gear surface and meshing with it would be a worm-gear type of component. Extending from the worm-gear type component may be a shaft. The shaft would continue through the housing and may extend as far as the exterior of the vehicle, e.g. the outside mold line of an aircraft surface. The shaft could terminate in an end which is flush with the vehicle exterior. In this embodiment the latch handle would not require opening in order to permit the operator to accomplish the desired load adjustment. The alternate embodiment would then operate essentially the same as the preferred embodiment desirable above for adjustment of the keeper load.

Another modification of the preferred embodiment may include the absence of the second set of ramp surfaces 65*b*, 66*b*, 67*b*. The user may eliminate such a feature of the preferred embodiment and substitute a different mechanism e.g. a surface normal to both the raised and recessed surface areas, by which the keeper's adjusted position is maintained, when under load. The user may intentionally release the load by reverse rotation of the drive element.

This and other modifications of the preferred embodiment are believed possible in view of the invention's teachings. Accordingly, the invention is limited in scope solely by the claims which follow.

What is claimed is:

1. A mechanism for adjusting a load applied through a keeper in a tension latch assembly, said mechanism comprising:

a housing;

a drive system constructed and arranged to react against said housing for adjustment of the keeper relative to a fixed-position hook in a latch assembly; and means for preventing said drive system from effecting additional adjustment of the keeper when a pre-determined load is achieved between the keeper and the hook;

said housing having a first portion, and a second portion separate from said first portion, said second portion being secured to said first portion;

said drive system including:

a nut having a first bearing surface and a second bearing surface for reacting against said first housing portion and said second housing portion respectively, and a threaded through-hole constructed for engagement with a threaded portion of the keeper, and a drive element having a through-hole therein through which the keeper extends for movement relative thereto, a surface constructed and arranged so as to be contained within and to bear against said first housing portion, and a portion accessible externally from said housing and constructed for effecting adjustment of the keeper;

said means for preventing said drive system from effecting additional adjustment of the keeper including:

said nut having a free end surface and at least two recessed areas thereon, a backing plate constructed for rotational movement with said drive element, said backing plate having at least two raised surface areas each constructed to be engaged with one of said nut recessed areas, and a ramp surface formed integral with each of said raised surface areas, and spring means, intermediate said backing plate and said drive element surface, for applying a pre-determined static spring load, said backing plate ramp surfaces being constructed and arranged to permit said backing plate to disengage from said nut when a pre-determined load between the keeper and the hook, achieved by operation of said drive system, exceeds said spring means pre-determined static spring load.

2. The mechanism of claim 1 wherein said means, for preventing said drive system from effecting additional adjustment of the keeper, is constructed and arranged to provide an audible and physical indication when a pre-determined load is achieved between the keeper and the hook.

* * * * *